US008363077B2

(12) United States Patent
Matsuhashi

(10) Patent No.: US 8,363,077 B2
(45) Date of Patent: Jan. 29, 2013

(54) TRANSFER MEDIUM MANUFACTURING METHOD AND TRANSFER MEDIUM

(75) Inventor: Kunihiko Matsuhashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 376 days.

(21) Appl. No.: 12/852,861

(22) Filed: Aug. 9, 2010

(65) Prior Publication Data

US 2011/0032321 A1 Feb. 10, 2011

(30) Foreign Application Priority Data

Aug. 10, 2009 (JP) ..... 2009-185929
Jul. 9, 2010 (JP) ..... 2010-157046

(51) Int. Cl.

| | |
|---|---|
| ***B44C 1/17*** | (2006.01) |
| ***B44C 1/16*** | (2006.01) |
| ***B44C 1/165*** | (2006.01) |
| ***B41M 3/12*** | (2006.01) |

(52) U.S. Cl. ..... 347/217; 427/146; 427/147

(58) Field of Classification Search ..... 347/217; 427/146, 147; 428/32.6
See application file for complete search history.

(56) References Cited

U.S. PATENT DOCUMENTS 6,984,440 B2 * 1/2006 Saito et al. ..... 428/195.1
2011/0033611 A1 * 2/2011 Matsuhashi ..... 427/123

FOREIGN PATENT DOCUMENTS

JP 02-034385 * 2/1990
JP 07-314879 12/1995

* cited by examiner

*Primary Examiner* — Huan Tran
(74) *Attorney, Agent, or Firm* — Workman Nydegger

(57) ABSTRACT

A transfer medium manufacturing method which manufactures a transfer medium in which a color material capable of being transferred to a target is attached to a base material, includes attaching first liquid containing the color material to the base material to form a colored layer, and attaching second liquid containing resin on the first liquid attached to the base material during the step of attaching the first liquid before the first liquid is dried, thereby forming a resin layer and forming a colored resin layer where the first liquid and the second liquid are mixed with each other.

4 Claims, 3 Drawing Sheets

TRANSFER MEDIUM MANUFACTURING METHOD AND TRANSFER MEDIUM

BACKGROUND

1. Technical Field

The present invention relates to a transfer medium which allows a pattern formed on a base material to be transferred to a target, and a transfer medium manufacturing method for manufacturing the transfer medium.

2. Related Art

In the related art, there is known a transfer medium which allows a pattern (a colored layer) such as characters, images or the like formed by attaching ink (first liquid) to a base material, to be transferred to a target. That is to say, when the pattern is transferred, the pattern, which is capable of being transferred and formed on a sheet (base material), is adhered to the target using an adhesive (resin layer) applied on the pattern, and thereby the pattern is detached from the sheet to be transferred to the target.

In recent years, there has been known a transfer medium in which an adhesive (second liquid) is applied on a pattern in accordance with a form of the pattern, as disclosed in, for example, JP-A-7-314879.

In the meantime, in JP-A-7-314879, the pattern is printed using a screen printing plate and the adhesive is applied on the pattern by using the screen printing plate used in the printing of the pattern. In other words, when the adhesive is applied, the adhesive is required to be applied in a state where the pattern is dried in order to be solidified in order to prevent destruction of the pattern by the adhesive coming in contact with the undried pattern formed on the sheet.

For this reason, the transfer medium has a problem in that since the pattern and the adhesive come in contact with each other's surfaces, adhesion between the pattern and the adhesive is weak, and when the pattern is transferred to an object (target), the transfer may not be performed because the pattern and the adhesive are detached from each other.

SUMMARY

An advantage of some aspects of the invention is to provide a transfer medium manufacturing method which increases adhesion between a colored layer and a resin layer and enables a good transfer to a target, and a transfer medium.

According to an aspect of the invention, there is provided a transfer medium manufacturing method which manufactures a transfer medium in which a color material capable of being transferred to a target is attached to a base material, including attaching first liquid containing the color material to the base material to form a colored layer; and attaching second liquid containing resin on the first liquid attached to the base material during the attaching the first liquid before the first liquid is dried, thereby forming a resin layer and forming a colored resin layer where the first liquid and the second liquid are mixed with each other.

According to this configuration, it is possible to manufacture the transfer medium having the colored resin layer where the first liquid and the second liquid are mixed with each other by attaching the second liquid on the first liquid in the state of having flowability before the first liquid is attached to the base material and dried. That is to say, the colored layer formed by the first liquid and the resin layer formed by the second liquid have adhesion stronger than a case where, for example, surfaces of the colored layer and the resin layer come in contact with each other, due to the formation of the colored resin layer where the first liquid and the second liquid are mixed with each other. Therefore, it is possible to manufacture the transfer medium which increases adhesion between the colored layer and the resin layer and enables a good transfer to a target.

The transfer medium manufacturing method may further include attaching a third liquid, which is transparent and protects a surface of the color material when the color material is transferred to the target, on the region on which the first liquid is attached to the base material before attaching the first liquid, thereby forming a protection layer, wherein the step of attaching the first liquid includes attaching the first liquid on the third liquid which is attached on the base material during the attaching the third liquid before the third liquid has dried, thereby forming the colored layer and a colored protection layer where the first liquid and the third liquid are mixed with each other.

According to this configuration, it is possible to protect the surface of the colored layer by the protection layer and to improve the durability of the colored layer transferred to a target, by attaching the first liquid on the region where the third liquid is attached. Also, it is possible to manufacture the transfer medium having the colored protection layer where the third liquid and the first liquid are mixed with each other by attaching the first liquid in the state of having flowability before the third liquid is attached to the base material and dried. That is to say, due to the formation of the colored protection layer where the first liquid and the third liquid are mixed with each other, the colored layer formed by the first liquid and the protection layer formed by the third liquid can have stronger adhesion as compared with the colored layer and the protection layer in a case where, for example, surfaces of the colored layer and the protection layer come in contact with each other.

According to another aspect of the invention, there is provided a transfer medium in which a color material capable of being transferred to a target is attached to a base material, including a colored layer that is formed by the first liquid including the color material; a resin layer that is formed by the second liquid including resin; and a colored resin layer where the first liquid and the second liquid are mixed with each other, wherein the colored layer, the resin layer, and the colored resin layer are formed on the base material.

According to this configuration, due to the formation of the colored resin layer where the first liquid and the second liquid are mixed with each other, the colored resin layer formed by the first liquid and the resin layer formed by the second liquid have stronger adhesion as compared with the colored layer and the resin layer in a case where, for example, surfaces of the colored layer and the resin layer come in contact with each other. Therefore, adhesion between the colored layer and the resin layer is increased, and a good transfer to a target is enabled.

In this case, in the transfer medium on the invention, a transparent protection layer, formed by the third liquid, and protects a surface of the color material when the color material is transferred to the target, the colored layer formed by the first liquid, and a colored protection layer where the third liquid and the first liquid are mixed with each other, may be formed on the base material.

According to this configuration, due to the formation of the colored protection layer where the third liquid and the first liquid are mixed with each other, the colored layer formed by the first liquid and the protection layer formed by the third liquid can have stronger adhesion as compared with the colored layer and the protection layer in a case where, for example, surfaces of the colored layer and the protection layer come in contact with each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, referring to FIGS. 1 to 5, an embodiment will be described in which the invention is embodied by a transfer medium manufacturing device which manufactures a transfer medium by ejecting ink on a film. In addition, it is assumed that in the following description of the specification, "front-back direction," "transverse direction," and "longitudinal direction" are shown by taking as a reference directions indicated by arrows in the figures such as FIG. 1 and the like.

Figure 1:
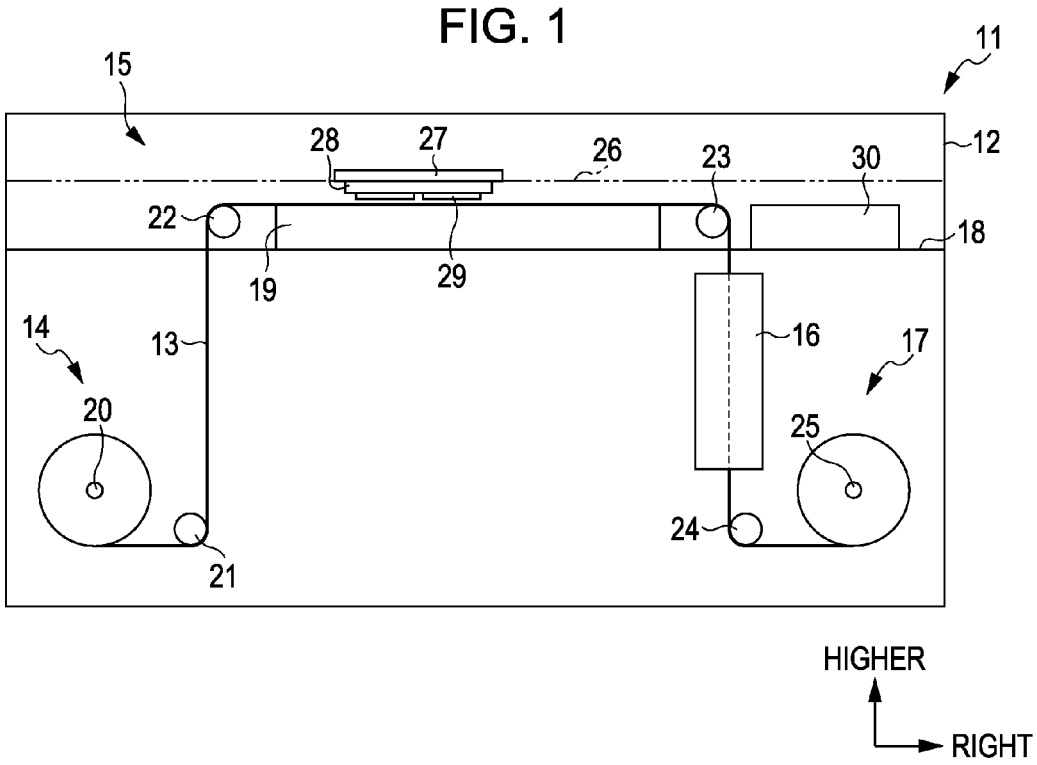
FIG. 1 is a schematic front view of a transfer medium manufacturing device according to an embodiment.

As shown FIG. 1, a transfer medium manufacturing device 11 is provided with a cuboid shaped main body case 12. The main body case 12 is provided with a feed portion 14 which feeds a film 13 having a long ruler shape as a base material, a printing room 15 where printing is performed by ejecting ink, which is first liquid, on the film 13, a drying device 16 which performs a drying processing for the film on which the ink is attached by the printing, and a winding portion 17 which winds the film 13 having undergone the drying processing.

That is to say, a plate shaped base 18, which partitions the inside of the main body case 12 into a higher portion and a lower portion, is installed at a slightly higher position than the central portion in the longitudinal direction in the main body case 12. A region positioned at a higher side than the base 18 becomes the printing room 15 which is formed by supporting a tetragonal board shaped platen 19 on the base 18. In a region positioned at a lower side than the base 18, the feed portion 14 is installed at the left side position which is an upstream side in the transport direction of the film 13, and the drying device 16 and the winding portion 17 are installed at the right side position which is a downstream side.

As shown in FIG. 1, the feed portion 14 is provided with a scroll 20, which rotatably extends in the front-back direction, and the film 13 is rotatably supported by the scroll axis 20 as a single body in a state where the film 13, is wound on the scroll 20 in a roll form in advance. That is to say, the scroll axis 20 is rotated based on a driving force of a transport motor 55 (see FIG. 3), and thereby the film 13 is fed from the feed portion 14 to be transported to the downstream side in the transport direction. The film 13 fed from the scroll 20 is sequentially wound and hung by a first roller 21, a second roller 22, a third roller 23, and a fourth roller 24 to change its transport direction, and is wound by a winding axis 25 which is provided in the winding portion 17 and rotated based on a driving force of the transport motor 55 (see FIG. 3).

In addition, in the printing room 15, the second roller 22 and the third roller 23, which are positioned opposite to each other with the platen 19 interposed therebetween in the transverse direction, are adjusted to be positioned such that a top portion of each circumferential surface has the same height as the upper surface of the platen 19. Therefore, in the printing room 15, a rear face of the film 13 transported to the downstream side between the second roller 22 and the third roller 23 comes in contact with the upper surface of the platen 19.

Also, as shown in FIG. 1, in both sides of the front and back of the platen 19 in the printing room 15, a pair of guide rails 26 (marked with the two-dot chain line in FIG. 1) is provided to extend in the transverse direction. Upper surfaces of the guide rails 26 are higher than the upper surface of the platen 19, and a tetragonal carriage 27 is supported on the upper surfaces of both guide rails 26 in a state of reciprocation along both guide rails 26 in the transverse direction, based on a driving of a driving mechanism (not shown). A recording head 29 is supported on a lower surface of the carriage 27 via a support plate 28.

The recording head 29 performs printing (recording) by ejecting ink on the film 13 supported by the platen 19 and functions as a liquid attaching means which ejects adhesive liquid as the second liquid and protection liquid as the third liquid on the film 13 to be attached thereto. In addition, in the printing room 15, a maintenance mechanism 30 is provided in a region positioned at the right side when seen from the third roller 23, and performs maintenance of the recording head 29 when printing is not performed.

Figure 2:
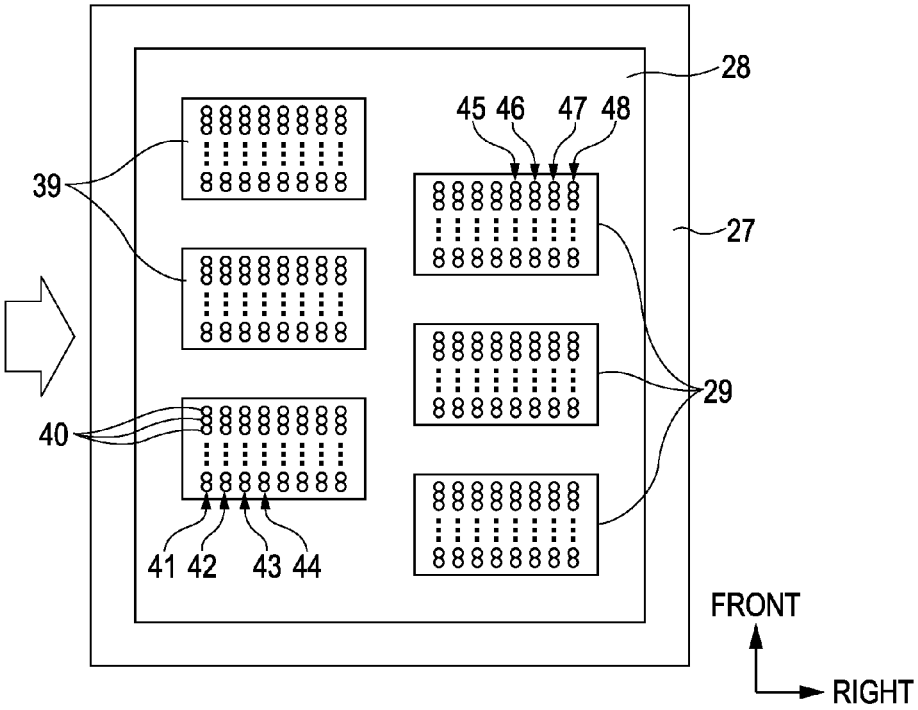
FIG. 2 is a schematic view illustrating a nozzle formation plane of a recording head.

As shown in FIG. 2, a plurality of recording heads 29 (six in this embodiment), which is supported by the support plate 28 supported on the lower surface of the carriage 27, is arranged in a zigzag form in a width direction (front-back direction) perpendicular to the transport direction (direction indicated by the outlined arrow in FIG. 2) of the film 13. Plural first to eight nozzle lines 41 to 48 (eight lines in this embodiment) each of which has a plurality of nozzles 40 along the front-back direction, are regularly formed at a predetermined interval in the transverse direction on a nozzle formation plane 39 which is a bottom of each recording head 29. The first to eight nozzle lines 41 to 48 configured in this way are respectively supplied with plural kinds of liquid from cartridges (not shown) corresponding to the respective nozzle lines 41 to 48, and the liquid is ejected from each nozzle 40 due to vibration of a piezoelectric element 49 (see FIG. 3) provided corresponding to each nozzle 40.

That is to say, ink containing color materials of various colors is supplied to the first to fifth nozzle lines 41 to 45 from the first nozzle line 41 positioned at the upmost stream side (the left side) in the transport direction in an order of cyan, magenta, yellow, black, and white. In addition, metal ink is supplied to the sixth nozzle line 46 positioned to be the sixth from the left side. The ink ejected from each of the first to sixth nozzle lines 41 to 46 is attached to the film 13 to form a colored layer 51 (see FIG. 5) as a pattern. The metal ink is obtained by dispersing metallic pigments which are color materials into liquid and is ink which, by being attached to the film 13, can form the colored layer 51 having a metal foil shape.

The seventh nozzle line 47 positioned to be the seventh from the left side is supplied with adhesive liquid. The adhesive liquid in this embodiment is obtained by dispersing microcapsules having an adhesive component containing resin into liquid, and increases adhesion due to destruction of the microcapsules by performing additional processing such as heating, pressing, or the like. The eighth nozzle line 48 positioned at the side furthest downstream (right side) in the transport direction of the film 13 is supplied with transparent protection liquid.

Figure 3:
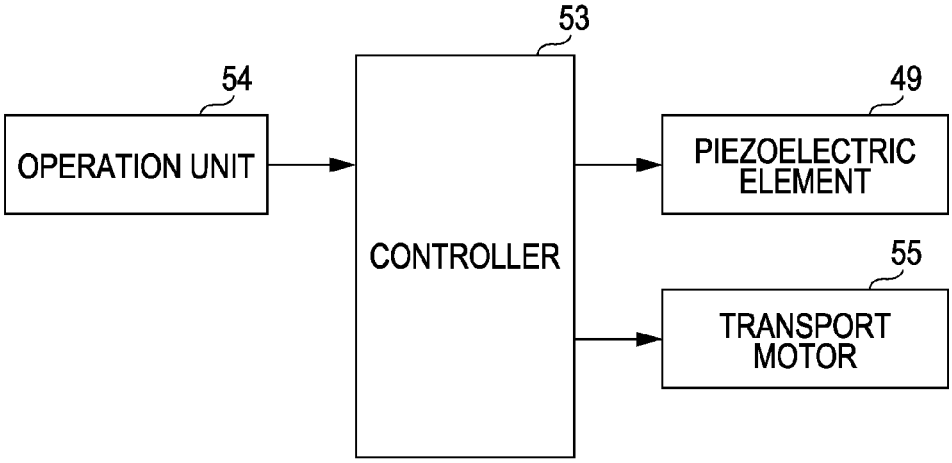
FIG. 3 is a block diagram of a control configuration.

As shown in FIG. 3, the transfer medium manufacturing device 11 is provided with a controller 53 which collectively controls driving of the transfer medium manufacturing device 11 and is constituted by a microcomputer and the like. The controller 53 controls driving of the piezoelectric element 49 and the transport motor 55 in response to an input from an operation unit 54 which is operated by a user.

A manufacturing method of a transfer medium 58 using the transfer medium manufacturing device 11 described above will be described with reference to FIGS. 4 and 5. As shown in FIG. 5A, in the film 13 in this embodiment, an upper surface 13*a* and a lower surface 13*b* thereof are respectively coated with a parting agent to form an upper parting layer 59 and a lower parting layer 60. The film 13 is assumed to be set in the transport path in a state where the downmost end of the film 13 in the transport direction can be wound by the winding axis 25 at a manufacturing start point of the transfer medium 58.

Figure 4:
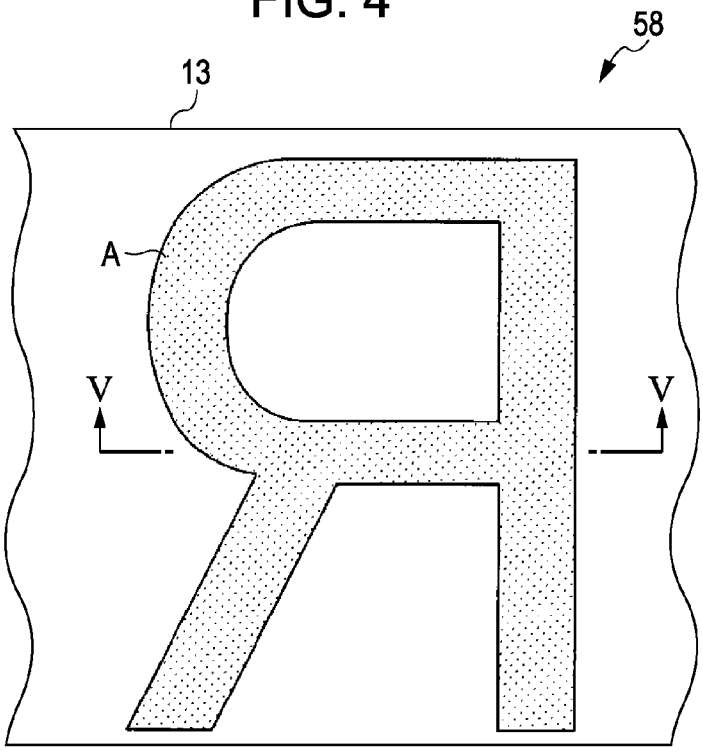
FIG. 4 is a schematic plan view of a transfer medium.
Figure 5A:
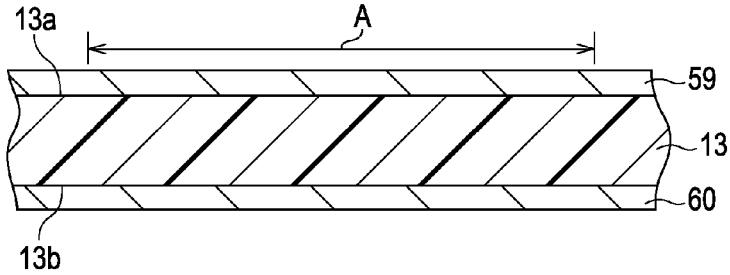
FIGS. 5A to 5D are sectional views when seen from the arrow V-V in FIG. 4, which are diagrams illustrating manufacturing procedures of a transfer medium.

As shown in FIG. 4 and FIG. 5A, as printing data such as characters, images or the like forming a transfer pattern, for example, when printing data of alphabet R is input, the controller 53 first sets a transfer region A where ink is to be attached. The transfer medium 58 manufactured in this embodiment transfers a transfer image formed on the transfer medium 58 to a target (not shown) in a mirror-reversed manner. For this reason, the controller 53 sets the transfer region A which is mirror-reversed with respect to a transfer image to be transferred. In addition, the target may be made of various materials such as plastic, metal, fabric, or the like, or may be made of mixture of various materials. In addition, the target may be bendable or have flexibility. A transfer surface of the target may be planar or solid.

When a user operates the operation unit 54 to start manufacturing of the transfer medium 58, the controller 53 vibrates the piezoelectric element 49 to attach the protection liquid, the ink, and the adhesive liquid to the film 13, respectively.

Figure 5B:
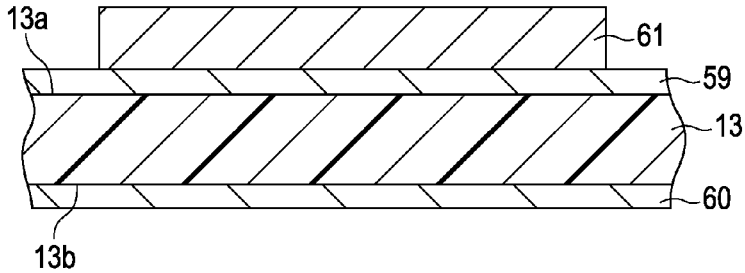

Specifically, the controller 53 first vibrates the piezoelectric element 49 corresponding to the eighth nozzle line 48 in accordance with the movement of the carriage 27 so as to attach the protection liquid on the transfer region A as shown in FIG. 5B. Therefore, a protection layer 61 is formed on the film 13 (third liquid attachment step).

Figure 5C:
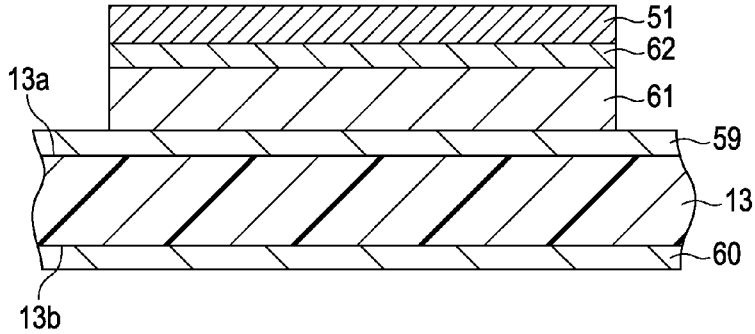

Next, the controller 53 vibrates the piezoelectric elements 49 corresponding to the first to sixth nozzle lines 41 to 46 in accordance with the movement of the carriage 27 to eject the ink on the transfer region A where the protection layer 61 is formed, thereby forming a colored layer 51 (first liquid attachment step), as shown in FIG. 5C. For example, when the transfer medium 58 for a foil transfer is manufactured, the colored layer 51 is formed by using the metal ink. Specifically, first, the metal ink is attached on the transfer region A and thereafter the white ink is attached on the transfer region A, thereby forming a silver colored layer 51.

In addition, the controller 53 enables the ink to be attached in a state of having flowability before the protection liquid is dried to be solidified. Therefore, a first middle layer 62 is formed as a colored protection layer by mixing the protection liquid and the ink. That is to say, the protection layer 61 formed by the protection liquid, the first middle layer 62 where the protection liquid and the ink are mixed with each other, and the colored layer 51 formed by the ink are laminated on the film 13.

Figure 5D:
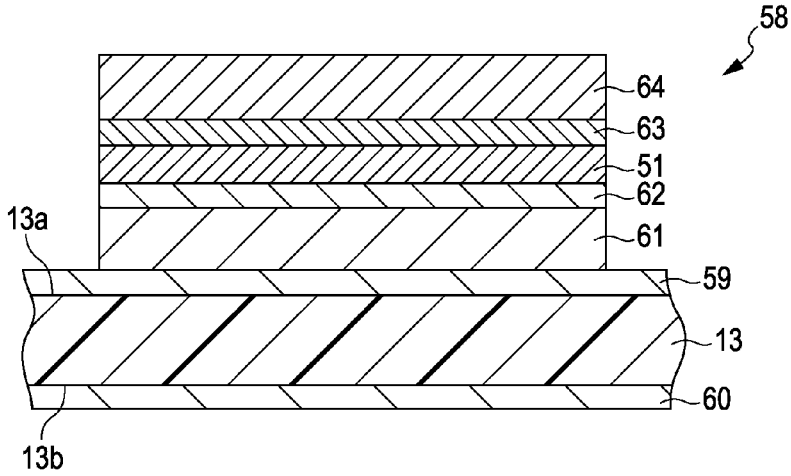

Next, the controller 53 vibrates the piezoelectric element 49 corresponding to the seventh nozzle line 47 in accordance with the movement of the carriage 27 to attach the adhesive liquid on the transfer region A as shown in FIG. 5D (second liquid attachment step).

In addition, the controller 53 enables the adhesive liquid to be attached in a state of having flowability before the ink is dried to be solidified. Therefore, a second middle layer 63 is formed as a colored resin layer by mixing the ink and the adhesive liquid. That is to say, the second middle layer 63 where the ink and the adhesive liquid are mixed with each other, and the adhesive layer 64 as a resin layer formed by the adhesive liquid are laminated on the colored layer 51.

After the completion of the printing for the film 13, the controller 53 drives the transport motor 55 to transport the film 13 to the downstream side in the transport direction such that the film 13 is dried in the drying device 16. Therefore, solvent is evaporated, and the protection layer 61, the first middle layer 62, the colored layer 51, the second middle layer 63, and the adhesive layer 64 are fixed on the film 13. Thereafter, the film 13 is wound on the winding axis 25 such that the adhesive layer 64 comes in contact with the lower parting layer 60.

The temperature at the drying device 16 is set to a level where the microcapsules in the adhesive layer 64 are not destroyed. Accordingly, the adhesion between the lower parting layer 60 and the adhesive layer 64 is weaker than the adhesion among the protection layer 61, the colored layer 51 and the adhesive layer 64 which are laminated with the first and second middle layers 62 and 63 interposed therebetween. Thus, when the wound film 13 is released, the lower parting layer 60 is detached from the adhesive layer 64, and, from the film 13 side, the protection layer 61, the first middle layer 62, the colored layer 51, the second middle layer 63, the adhesive layer 64 are sequentially laminated on the upper surface 13*a* of the film 13.

In addition, the adhesion among the protection layer 61, the colored layer 51 and the adhesive layer 64 which are laminated with the first and second middle layers 62 and 63 interposed therebetween is stronger than the adhesion between the protection layer 61 and the upper parting layer 59. For this reason, when the colored layer 51 is transferred to a target, additional processing is performed for the adhesive layer 64 to destroy the microcapsules. The adhesive layer 64 showing adhesiveness is adhered to the target to perform the detachment for the film 13 such that the protection layer 61 is detached from the upper parting layer 59, and the colored layer 51 is transferred to the target in the state where a surface of the colored layer 51 is protected by the protection layer 61.

According to the above-described embodiment, the following effects can be achieved.

(1) It is possible to manufacture the transfer medium 58 having the second middle layer 63 where the ink and the adhesive liquid are mixed with each other by attaching the adhesive liquid on the ink in the state of having flowability before the ink is attached to the film 13 and dried. That is to say, the colored layer 51 formed by the ink and the adhesive layer 64 formed by the adhesive liquid have adhesion stronger than a case where, for example, surfaces of the colored layer 51 and the adhesive layer 64 come in contact with each other, due to the formation of the second middle layer 63 where the ink and the adhesive liquid are mixed with each other. Therefore, it is possible to manufacture the transfer medium 58 which increases adhesion between the colored layer 51 and the adhesive layer 64 and enables a good transfer to a target.

(2) It is possible to protect the surface of the colored layer 51 by the protection layer 61 and to improve the durability of the colored layer 51 transferred to a target, by attaching the ink on the transfer region A where the protection liquid is attached. Also, it is possible to manufacture the transfer medium 58 having the first middle layer 62 where the protection liquid and the ink are mixed with each other by attaching the ink in the state of having flowability before the protection liquid is attached to the film 13 and dried. That is to say, due to the formation of the first middle layer 62 where the ink and the protection liquid are mixed with each other, the colored layer 51 formed by the ink and the protection layer 61 formed by the protection liquid can have stronger adhesion as compared with the colored layer 51 and the protection layer 61 in a case where, for example, surfaces of the colored layer 51 and the protection layer 61 come in contact with each other.

(3) Due to the formation of the second middle layer 63 where the ink and the adhesive liquid are mixed with each other, the colored layer 51 formed by the ink and the adhesive layer 64 formed by the adhesive liquid have stronger adhesion as compared with the colored layer 51 and the adhesive layer 64 in a case where, for example, surfaces of the colored layer 51 and the adhesive layer 64 come in contact with each other. Therefore, adhesion between the colored layer 51 and the adhesive layer 64 is increased, and a good transfer to a target is possible.

(4) Due to the formation of the protection layer 61 between the film 13 and the colored layer 51, the colored layer 51 can be formed regardless of the compatibility of the film 13 and the ink. That is to say, for example, even when printing is performed on the film 13 made of waterproof resin by using liquid which is colored by a color material such as dye or pigment, it is possible to increase a fixable characteristic by forming the protection layer 61 by using transparent coating agent containing inorganic particulates such as silica or swellable resin.

(5) It is possible to attach the adhesive liquid to the film 13 in the state of maintaining the microcapsules by vibrating the piezoelectric element 49 to eject the adhesive liquid. That is to say, it is possible to suppress the nozzle 40 from being blocked since the adhesive liquid can be ejected in the state where the adhesion of the adhesive liquid is lowered.

The above-described embodiment may be modified as follows.

It is also possible that the drying processing is performed for the film 13 supported on the platen 19 by providing a drying means such as a heater which is buried in the platen 19 and which applies heat to the platen, a radiation heater which radiates electromagnetic waves onto the platen 19 for heating, or a blower which blows wind (hot wind). That is to say, the protection liquid and the ink, and the ink and the adhesive liquid attached on the film are mixed with each other according to their flowability. Thus, when evaporation of the solvent of the ink attached on the film is facilitated, the flowability of the protection liquid and the ink is lowered, and thereby the amount where the protection liquid and the ink, and the ink and the adhesive liquid are mixed with each other is decreased. Accordingly, it is possible to adjust the thickness of the first and second middle layers 62 and 63 by performing the drying processing.

The heads for ejecting the ink, the protection liquid, and the adhesive liquid may be provided independently.

The protection liquid need not be attached and the protection layer 61 need not be formed. In addition, a film on which the protection layer is formed may be used.

A mechanism for ejecting a parting layer material may be provided in the recording head 29, and the upper parting layer 59 may be formed by ejecting the parting layer material to the film 13. In this case, the parting layer material may be ejected to the transfer region A, and the upper parting layer 59 may be formed in accordance with a shape of the colored layer 51.

The adhesive liquid may employ a thermosetting resin, or a thermoplastic resin which is softened by heating and hardened by cooling.

Specifically, the thermoplastic resin may use acrylic acid ester resin, methacrylate ester resin, acrylic acid ester-methacrylate ester copolymer resin, acrylic acid ester-styrene copolymer resin, acrylic acid ester-methacrylate ester-styrene copolymer resin, polyvinyl alcohol resin, ethylene-vinyl acetate copolymer resin, styrene-butadiene copolymer resin, silicon resin, rosin modified rosin and derivatives thereof, polyurethane resin, vinyl acetate resin, or the like.

An ultraviolet cured adhesive may be used as the adhesive liquid, and irradiation of ultraviolet rays may be performed as the additional processing. In addition, as the adhesive liquid, there may be used liquid containing tackifier, filler, disperser, antifoamer, viscosity modifier, flame retarder, anti-aging agent, thermal stabilizer, and the like.

For the protection liquid, there may be used liquid containing, for example, acrylic acid ester resin, methacrylate ester resin, acrylic acid ester-methacrylate ester copolymer resin, acrylic acid ester-styrene copolymer resin, acrylic acid ester-methacrylate ester-styrene copolymer resin, polyvinyl alcohol resin, or the like.

For the ink, there may be used liquid containing, for example, acrylic acid ester resin, methacrylate ester resin, acrylic acid ester-methacrylate ester copolymer resin, acrylic acid ester-styrene copolymer resin, polyurethane resin, vinyl chloride-vinyl acetate copolymer resin, cellulose derivative, polyvinyl butyral resin, poly acrylic polyol resin, or the like.

The entire disclosure of Japanese Patent Application No.: 2009-185929, filed Aug. 10, 2009 and 2010-157046, filed Jul. 9, 2010 are expressly incorporated by reference herein.

What is claimed is:

1. A transfer medium manufacturing method, which manufactures a transfer medium in which a color material capable of being transferred to a target is attached to a base material, comprising:

attaching first liquid containing the color material to the base material to form a colored layer; and attaching second liquid containing resin on the first liquid attached to the base material in the attaching the first liquid before the first liquid is dried, thereby forming a resin layer and forming a colored resin layer where the first liquid and the second liquid are mixed with each other.

2. The transfer medium manufacturing method according to claim 1, further comprising:

attaching third liquid, which is transparent and protects a surface of the color material when the color material is transferred to the target, on a region on which the first liquid is attached in the base material before attaching the first liquid, thereby forming a protection layer, wherein the step of attaching the first liquid includes attaching the first liquid on the third liquid which is attached on the base material during the attaching the third liquid before the third liquid is dried, thereby forming the colored layer and a colored protection layer where the first liquid and the third liquid are mixed with each other.

3. A transfer medium in which a color material capable of being transferred to a target is attached to a base material, comprising:

a colored layer that is formed by first liquid including the color material;

a resin layer that is formed by second liquid including resin; and a colored resin layer where the first liquid and the second liquid are mixed with each other, wherein the colored layer, the resin layer, and the colored resin layer are formed on the base material.

4. The transfer medium according to claim 3, wherein a protection layer that is transparent, formed by third liquid, and protects a surface of the color material when the color material is transferred to the target, the colored layer formed by the first liquid, and a colored protection layer where the third liquid and the first liquid are mixed with each other, are formed on the base material.

* * * * *